US010224682B2

(12) United States Patent
Watanabe et al.

(10) Patent No.: US 10,224,682 B2
(45) Date of Patent: Mar. 5, 2019

(54) COAXIAL CABLE AND METHOD FOR MANUFACTURING THE SAME

(71) Applicant: SUMITOMO ELECTRIC INDUSTRIES, LTD., Osaka-shi, Osaka (JP)

(72) Inventors: Yoshimasa Watanabe, Kanuma (JP); Kazuhiro Sato, Kanuma (JP); Hitomi Yoshida, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/625,306

(22) Filed: Jun. 16, 2017

(65) Prior Publication Data

US 2017/0365963 A1 Dec. 21, 2017

(30) Foreign Application Priority Data

Jun. 20, 2016 (JP) ..... 2016-121878

(51) Int. Cl.
*H01R 9/05* (2006.01)
*H01R 25/00* (2006.01)
(Continued)

(52) U.S. Cl.
CPC ..... *H01R 25/006* (2013.01); *H01B 7/0823* (2013.01); *H01B 7/18* (2013.01);
(Continued)

(58) Field of Classification Search
CPC .... H01R 25/006; H01R 9/0506; H01R 43/02; H01R 2103/00; H01B 7/18; H01B 11/20;
(Continued)

(56) References Cited

U.S. PATENT DOCUMENTS 3,701,964 A * 10/1972 Cronin ..... H01R 12/774 174/261
4,602,832 A * 7/1986 Cunningham ..... H01R 23/6873 439/108

(Continued)

FOREIGN PATENT DOCUMENTS

JP 2012-234761 A 11/2012

*Primary Examiner* — Abdullah A Riyami
*Assistant Examiner* — Vladimir Imas
(74) *Attorney, Agent, or Firm* — Drinker Biddle & Reath LLP

(57) ABSTRACT

A coaxial cable includes a coaxial wire in which an inner insulator, an outer conductor and a sheath are sequentially and coaxially provided around a center conductor, and a substrate having a surface on which a first contact pad and a second contact pad are arranged. The sheath is removed at one end portion of the coaxial wire by a predetermined length, so that the inner insulator and the outer conductor are exposed, and a tip end of the inner insulator is removed by a predetermined length, so that the center conductor is exposed. The exposed portion of the center conductor is soldered to the first contact pad with the exposed portion of the inner insulator being bent relative to the sheath, and the exposed portion of the outer conductor is soldered to the second contact pad with being bent in a direction different from the bending direction of the inner insulator. A part of the coaxial wire covered by the sheath is standing at an angle of 30° or greater relative to the surface of the substrate.

4 Claims, 4 Drawing Sheets

(51) Int. Cl.

| | |
|---|---|
| ***H01B 7/08*** | (2006.01) |
| ***H01B 7/18*** | (2006.01) |
| ***H01B 11/10*** | (2006.01) |
| ***H01B 11/20*** | (2006.01) |
| ***H01B 13/016*** | (2006.01) |
| ***H01B 13/06*** | (2006.01) |
| ***H01R 43/02*** | (2006.01) |
| ***H01R 12/53*** | (2011.01) |
| *H01B 7/02* | (2006.01) |
| *H01R 103/00* | (2006.01) |

(52) U.S. Cl.
CPC ..... *H01B 11/1016* (2013.01); *H01B 11/20* (2013.01); *H01B 13/016* (2013.01); *H01B 13/067* (2013.01); *H01R 9/0506* (2013.01); *H01R 9/0515* (2013.01); *H01R 12/53* (2013.01); *H01R 43/02* (2013.01); *H01B 7/0241* (2013.01); *H01R 2103/00* (2013.01)

(58) Field of Classification Search
CPC ..... H01B 11/1016; H01B 13/016; H01B 13/067; H01B 7/0241
USPC ..... 439/579, 581
See application file for complete search history.

(56) References Cited

U.S. PATENT DOCUMENTS 4,831,456 A * 5/1989 Takamura ..... A61B 1/05 348/294
4,865,933 A * 9/1989 Blanyer ..... B21C 23/24 29/2
4,918,521 A * 4/1990 Yabe ..... A61B 1/00179 348/373
4,985,000 A * 1/1991 Tengler ..... H01R 13/6585 439/445
5,290,191 A * 3/1994 Foreman ..... G06F 21/00 439/225
5,647,870 A * 7/1997 Kordis ..... A61B 5/0422 606/41
5,813,881 A * 9/1998 Nathan ..... G01R 1/04 257/529
5,829,991 A * 11/1998 Murphy ..... H01R 9/034 439/98
6,100,626 A * 8/2000 Frey ..... H01R 4/04 310/334
6,371,805 B1 * 4/2002 Wang ..... H01R 9/0512 439/581
6,386,913 B1 * 5/2002 Mohammad ..... H01R 24/50 439/579
6,540,548 B1 * 4/2003 Zhang ..... H01R 43/28 174/88 R
6,580,034 B2 * 6/2003 Daane ..... H01B 7/0892 174/113 R
6,692,262 B1 * 2/2004 Loveless ..... H01R 24/50 439/581
6,719,578 B1 * 4/2004 Klassen ..... H01R 13/523 439/20
7,320,616 B1 * 1/2008 Legrady ..... H01R 4/2433 439/404
7,416,415 B2 * 8/2008 Hart ..... H01R 24/52 439/579
7,510,425 B2 * 3/2009 Kuo ..... H05K 3/3405 439/493
7,845,986 B2 * 12/2010 Yasumura ..... H01R 12/52 439/637
8,292,655 B1 * 10/2012 Ling ..... H01R 9/038 439/497
8,569,627 B1 * 10/2013 Salz ..... H01B 7/0892 174/102 R
8,791,366 B2 * 7/2014 Nonen ..... H01R 9/035 174/113 R
8,996,126 B2 * 3/2015 Stevenson ..... A61N 1/05 607/115
9,178,287 B2 * 11/2015 Tanaka ..... H01R 4/00
9,412,495 B1 * 8/2016 Bennett ..... H01B 7/185
9,413,121 B2 * 8/2016 Poulsen ..... H01R 13/6658
9,673,587 B2 * 6/2017 Pechter ..... H01R 43/28
9,793,663 B2 * 10/2017 Poulsen ..... H01R 24/64
9,837,778 B2 * 12/2017 Pechter ..... H01R 43/28

* cited by examiner

COAXIAL CABLE AND METHOD FOR MANUFACTURING THE SAME

CROSS-REFERENCE TO RELATED APPLICATION

The present application claims priority from Japanese Patent Application No. 2016-121878 filed on Jun. 20, 2016 the entire content of which is incorporated herein by reference.

BACKGROUND

Technical Field

The present invention relates to a coaxial cable and a method for manufacturing the same.

Related Art

Patent Document 1 discloses a multi-core cable in which center conductors and outer conductors exposed at terminal portions of a plurality of coaxial wires aligned in a planar shape are respectively connected to contact pads (signal conductors and a ground conductor) on a circuit substrate. [Patent Document 1] Japanese Patent Application Publication No. 2012-234761A In the cable disclosed in Patent Document 1, the coaxial wire is attached to the contact pad on the circuit substrate along a surface of the circuit substrate, at a connecting part of the coaxial wire to the circuit substrate. In order to attach the plurality of coaxial wires to the circuit substrate, it is necessary to align and arrange the respective contact pads. However, there is room for improvement in the arrangement configuration of the coaxial wires on the circuit substrate, such as a case where the coaxial wires are attached to a substrate having a limited processing area.

SUMMARY

The present invention provides a coaxial cable having a high degree of freedom of an arrangement configuration of coaxial wires upon attachment of the coaxial wires on a substrate and a method for manufacturing the same.

A coaxial cable according to the present invention, comprises:

a coaxial wire in which an inner insulator, an outer conductor and a sheath are sequentially and coaxially provided around a center conductor; and a substrate having a surface on which a first contact pad and a second contact pad are arranged, wherein the sheath is removed at one end portion of the coaxial wire by a predetermined length, so that the inner insulator and the outer conductor are exposed, and a tip end of the inner insulator is removed by a predetermined length, so that the center conductor is exposed, wherein the exposed portion of the center conductor is soldered to the first contact pad with the exposed portion of the inner insulator being bent relative to the sheath, and the exposed portion of the outer conductor is soldered to the second contact pad with being bent in a direction different from the bending direction of the inner insulator, and wherein a part of the coaxial wire covered by the sheath is standing at an angle of 30° or greater relative to the surface of the substrate.

A method of manufacturing a coaxial cable according to the present invention, comprises:

at a terminal portion of a coaxial wire in which an inner insulator, an outer conductor and a sheath are sequentially and coaxially provided around a center conductor, removing the sheath by a predetermined length to expose the inner insulator and the outer conductor and removing a tip end of the inner insulator by a predetermined length to expose the center conductor;

soldering the exposed portion of the center conductor to a first contact pad of a substrate with the inner insulator or the center conductor exposed from the sheath being bent relative to the sheath; and bending the exposed portion of the outer conductor in a direction different from the bending direction of the inner insulator or the center conductor and soldering the same to a second contact pad of the substrate, and standing a part of the coaxial wire covered by the sheath so as to form an angle of 30° or greater relative to the substrate.

According to the present invention, it is possible to provide the coaxial cable having a high degree of freedom of an arrangement configuration of the coaxial wires upon attachment of the coaxial wires on the substrate and the method for manufacturing the same.

DETAILED DESCRIPTION

Figure 1:
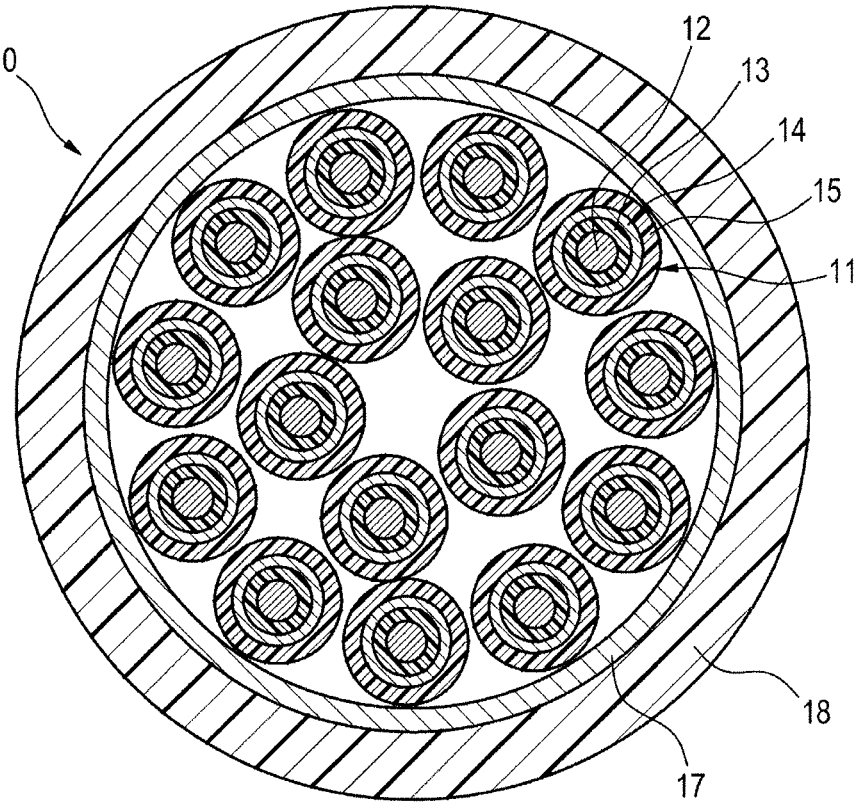
FIG. 1 is a sectional view depicting an example of a coaxial cable of the present invention.

Description of Exemplary Embodiment of Present Invention

First, an exemplary embodiment of the present invention is described.

A coaxial cable according to an exemplary embodiment of the present invention, comprises:

(1) a coaxial wire in which an inner insulator, an outer conductor and a sheath are sequentially and coaxially provided around a center conductor; and a substrate having a surface on which a first contact pad and a second contact pad are arranged, wherein the sheath is removed at one end portion of the coaxial wire by a predetermined length, so that the inner insulator and the outer conductor are exposed, and a tip end of the inner insulator is removed by a predetermined length, so that the center conductor is exposed, wherein the exposed portion of the center conductor is soldered to the first contact pad with the exposed portion of the inner insulator being bent relative to the sheath, and the exposed portion of the outer conductor is soldered to the second contact pad with being bent in a direction different from the bending direction of the inner insulator, and wherein a part of the coaxial wire covered by the sheath is standing at an angle of 30° or greater relative to the surface of the substrate.

According to the above configuration, it is possible to improve a degree of freedom of an arrangement configuration of the coaxial wires upon attachment of the coaxial wires on the substrate.

(2) The first contact pad may comprise a plurality of contact pads arranged on the same circumference on the substrate, the second contact pad may be arranged inside the same circumference on the substrate, and each of the center conductors exposed from a plurality of the coaxial wires may be fixed to each of the plurality of first contact pads and the respective outer conductors exposed from the plurality of coaxial wires are fixed to the second contact pad, so that the plurality of coaxial wires is arranged in a cylinder shape.

The second contact pad may be one or plural. It is preferable to annularly arrange the second contact pads for the plurality of the coaxial wires (which may be one contact pad or two or more contact pads) so that the number of the second contact pads becomes small.

The above configuration cannot be implemented in a configuration of the related art where coaxial wires are aligned with being laid down on a substrate. According to the above configuration, it is possible to connect the coaxial wires to the substrate having a limited processing area, so that it is possible to implement miniaturization of the substrate.

(3) The substrate may comprise a first substrate and a second substrate arranged above the first substrate and having an opening formed at a central portion thereof, the plurality of coaxial wires may be arranged in a cylinder shape having a plurality of layers, and the coaxial wires to be connected to the first substrate may pass through the opening of the second substrate.

According to the above configuration, the substrate is divided into a plurality of substrates, so that it is possible to make each substrate smaller and to attach the more coaxial wires to the substrates.

A method of manufacturing a coaxial cable, according to an exemplary embodiment of the present invention, comprises:

(4) (a) at a terminal portion of a coaxial wire in which an inner insulator, an outer conductor and a sheath are sequentially and coaxially provided around a center conductor, removing the sheath by a predetermined length to expose the inner insulator and the outer conductor and removing a tip end of the inner insulator by a predetermined length to expose the center conductor;

(b) soldering the exposed portion of the center conductor to a first contact pad of a substrate with the inner insulator or the center conductor exposed from the sheath being bent relative to the sheath; and (c) bending the exposed portion of the outer conductor in a direction different from the bending direction of the inner insulator or the center conductor and soldering the same to a second contact pad of the substrate, and standing a part of the coaxial wire covered by the sheath so as to form an angle of 30° or greater relative to the substrate.

According to the above configuration, it is possible to improve the degree of freedom of the arrangement configuration of the coaxial wires upon attachment of the coaxial wires on the substrate.

(5) In the process (b) of soldering the exposed portion of the center conductor, each of the center conductors exposed from a plurality of the coaxial wires may be fixed to each of a plurality of the first contact pads arranged on the same circumference on the substrate, and in the process (c) of soldering the exposed portion of the outer conductor, the respective outer conductors exposed from the plurality of coaxial wires may be fixed to the second contact pad arranged inside the same circumference on the substrate.

According to the above configuration, it is possible to implement miniaturization of the substrate.

The method may further comprise:

(d) letting some coaxial wires of the plurality of coaxial wires pass through the opening of the second substrate;

(e) executing the process (b) of soldering the exposed portion of the center conductor and the process (c) of soldering the exposed portion of the outer conductor for the coaxial wires having not passed through the opening of the second substrate, on the second substrate; and (f) executing the process (b) of soldering the exposed portion of the center conductor and the process (c) of soldering the exposed portion of the outer conductor for the coaxial wires having passed through the opening of the second substrate, on the first substrate.

According to the above configuration, the substrate is divided into a plurality of substrates, so that it is possible to make each substrate smaller and to attach the more coaxial wires to the substrates.

Details of Exemplary Embodiment of Present Invention

Hereinafter, examples of an exemplary embodiment of a coaxial cable having the substrate and a method for manufacturing the same of the present invention will be described with reference to the drawings.

As shown in FIG. 1, a coaxial cable 10 of the exemplary embodiment has a plurality of (sixteen, for example) coaxial wires 11. The coaxial wire 11 has a center conductor 12, an inner insulator 13 provided on an outer periphery of the center conductor 12, an outer conductor 14 provided on an outer periphery of the inner insulator 13 and an insulating sheath 15 provided on an outer periphery of the outer conductor 14, which are coaxially arranged. The coaxial wire 11 of the exemplary embodiment is preferably configured by a thin electric wire in which a cross-sectional area of the center conductor 12 is equal to or smaller than 0.005 $mm^2$ (AWG40 or less). It is advantageous for the coaxial wire 11 to be thin so that the coaxial wire 11 is to stand up (standing at a predetermined angle) on a substrate 20 (which will be described later).

As an example, the center conductor 12 of the coaxial wire 11 of the exemplary embodiment is configured by a stranded wire formed by stranding a plurality of thin metal wires, which are annealed copper wires or copper alloy wires. The thin metal wire may be plated. The inner insulator 13 is formed of a fluororesin such as PFA (Tetrafluoroethylene-Perfluoroalkylvinylether Copolymer), ETFE (Tetrafluoroethylene-Ethylene Copolymer), FEP (Tetrafluoroethylene-hexa fluoropropylene Copolymer), PTFE (polytetrafluoroethylene) and the like, for example. The outer conductor 14 is configured by a plurality of wrapped thin metal wires, a copper foil or a copper-deposited polyester tape, for example. The sheath 15 is formed of polyester, fluororesin or the like, for example.

A surrounding of the plurality of coaxial wires 11 is covered by a shield layer 17. An outer periphery of the shield layer 17 is covered by a sheath 18. In the meantime, a configuration where the surrounding of the plurality of coaxial wires 11 is wrapped by a wrapping tape formed of a resin tape (which is preferably conductive) or the like and a surrounding of the wrapping tape is covered by the shield layer 17 is also possible. The shield layer 17 is configured by helically wrapping or braiding a thin metal wire. Also, the sheath 18 is formed of polyvinyl chloride (PVC), polyolefin-based resin or the like, for example.

Figure 2:
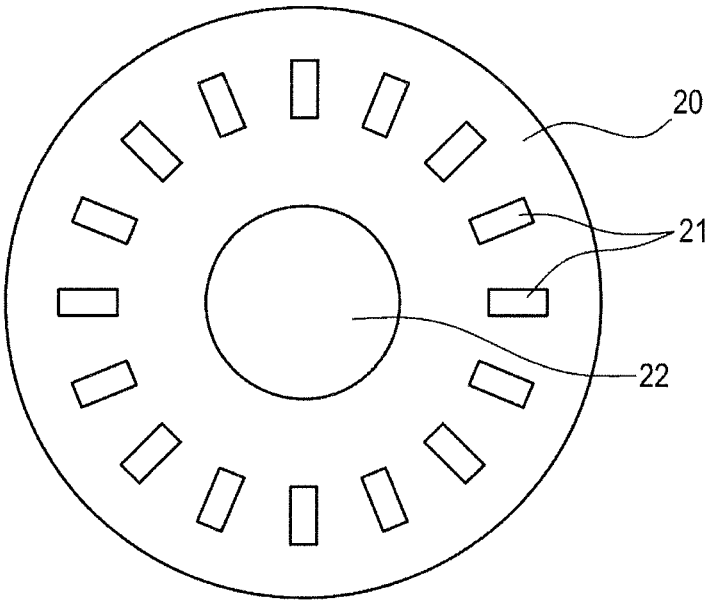
FIG. 2 is a plan view of a circular substrate to which coaxial wires of FIG. 1 are to be attached.

FIG. 2 is a plan view of a printed substrate 20 to which the coaxial wires 11 are to be attached. As shown in FIG. 2, the printed substrate 20 has a plurality of signal pads 21 (an example of the first contact pad) and a ground pad (an example of the second contact pad). The plurality of signal pads 21 is arranged on the same circumference of an upper surface of the printed substrate 20 and configures a part of an electric pattern of the printed substrate 20. Each of the signal pads 21 is electrically connected to the center conductor 12 of each coaxial wire 11 by soldering of pulse heat, for example. The ground pad 22 is a substantially circular contact pad for grounding each coaxial wire 11 and is provided inside the circumference formed by the plurality of signal pads 21. The ground pad 22 configures a part of the electric pattern of the printed substrate 20 and is electrically connected to the outer conductor 14 of each coaxial wire 11 by soldering of pulse heat, for example, like the signal pad 21. When connecting the outer conductors 14 to the ground pad 22, parts of the outer conductors 14 are cut and the outer conductors 14 are integrated in an opposite direction to a bending direction of the inner insulators 13, and thereby the outer conductors can be easily connected to the ground pad 22. In FIG. 2, the ground pad 22 is one. However, a plurality of ground pads may also be provided. For example, the same number of the ground pads 22 as the number of the coaxial wires 11 may be provided (in this case, the ground pads are also annularly arranged (on the same circumference)).

Figure 3:
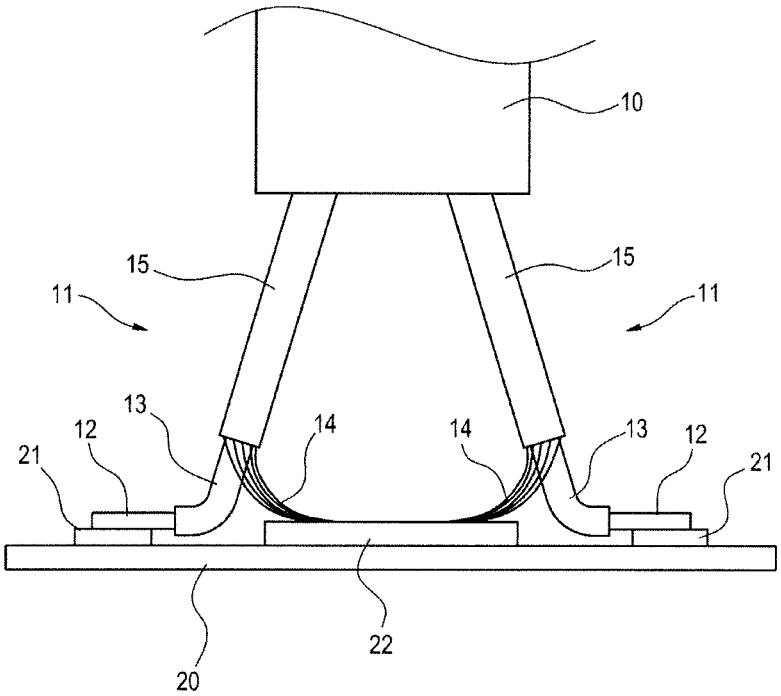
FIG. 3 is a side view depicting a state where a center conductor and an outer conductor exposed from one coaxial wire are respectively attached to a signal contact pad and a ground contact pad on the circular substrate of FIG. 2.

As shown in FIG. 3, the shield layer 17 and the sheath 18 are removed at one end-side of the coaxial cable 10, so that the plurality of coaxial wires 11 included in the coaxial cable 10 is exposed by predetermined lengths. Each coaxial wire 11 exposed from the coaxial cable 10 is subjected to terminating processing (leading processing) at a terminal portion thereof by laser irradiation, so that the inner insulator 13 and the outer conductor 14 are exposed from a tip end-side of the coaxial wire 11 by predetermined lengths (for example, about 0.2 to 2.0 mm). A tip end of the exposed inner insulator 13 is further subjected to the terminating processing, so that the center conductor 12 is exposed by a predetermined length (for example, 0.2 to 2.0 mm). The exposed lengths of the inner insulator 13 and the center conductor 12 are made longer than the exposed length of the outer conductor 14, so that a virtual triangle of which respective sides are the inner insulator 13, the outer conductor 14 and the printed substrate 20 is configured as a right triangle (a right angle is an angle between the inner insulator 13 and the outer conductor 14) and the coaxial wire 11 is made to stand up from the right angle portion, and thereby the coaxial wire 11 is rigidly fixed to the printed substrate 20.

With the coaxial wire 11 terminating-processed in this way, the inner insulator 13 exposed from the sheath 15 is bent relative to the sheath 15 and at this state, the center conductor 12 exposed from the inner insulator 13 is soldered to the signal pad 21 on the printed substrate 20. In the meantime, when the outer conductor 14 exposed from the sheath 15 is configured by the thin metal wires, for example, the thin metal wires are integrated and bent in a direction different from the bending direction of the inner insulator 13 and are then soldered to the ground pad 22. In this way, the center conductor 12 and inner insulator 13 and the outer conductor 14 exposed at the terminal portion of the coaxial wire 11 are respectively soldered and fixed to the signal pad 21 and the ground pad 22 with being bent in the different direction, so that a part of the coaxial wire 11 covered by the sheath 15 is standing at a predetermined angle relative to the upper surface of the printed substrate 20, i.e., is arranged to stand up from the upper surface of the printed substrate 20. An angle between the part of the coaxial wire 11 covered by the sheath 15 and the upper surface of the printed substrate 20 is preferably within a range of 30° to 90° of a minor angle. Thereby, in the exemplary embodiment, the coaxial wire 11 can stand substantially upright (at an angle of 70° to 90° relative to the printed substrate 20) from the printed substrate 20.

Figure 4:
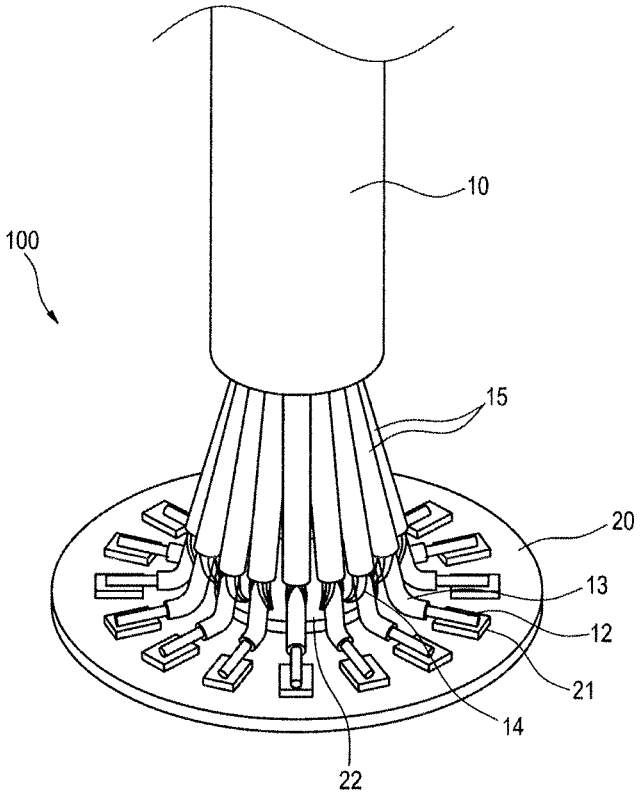
FIG. 4 is a perspective view depicting a state where respective conductors of a plurality of coaxial wires exposed from the coaxial cable are attached to a plurality of signal contact pads and a ground contact pad on the circular substrate of FIG. 2.

In the exemplary embodiment, by the connection method as shown in FIG. 3, the respective center conductors 12 exposed from the plurality of coaxial wires 11 are soldered to the plurality of signal pads 21 provided on the upper surface of the printed substrate 20 and the respective outer conductors 14 exposed from the coaxial wires 11 are soldered to the ground pad 22. Thereby, as shown in FIG. 4, for example, it is possible to arrange the plurality of coaxial wires 11 accommodated in the coaxial cable 10 in a cylinder shape at connecting parts to the printed substrate 20. In this way, a coaxial cable 100 having a substrate is manufactured.

According to the coaxial cable 100 having a substrate of the exemplary embodiment, it is possible to improve a degree of freedom of the arrangement configuration of the coaxial wires 11 upon attachment of the coaxial wires 11 onto the printed substrate 20. For this reason, it is possible to connect the plurality of coaxial wires 11 onto the printed substrate 20 at a place in which a processing area is limited, such as a catheter, so that it is possible to implement the further miniaturization of the printed substrate 20.

Figure 5:
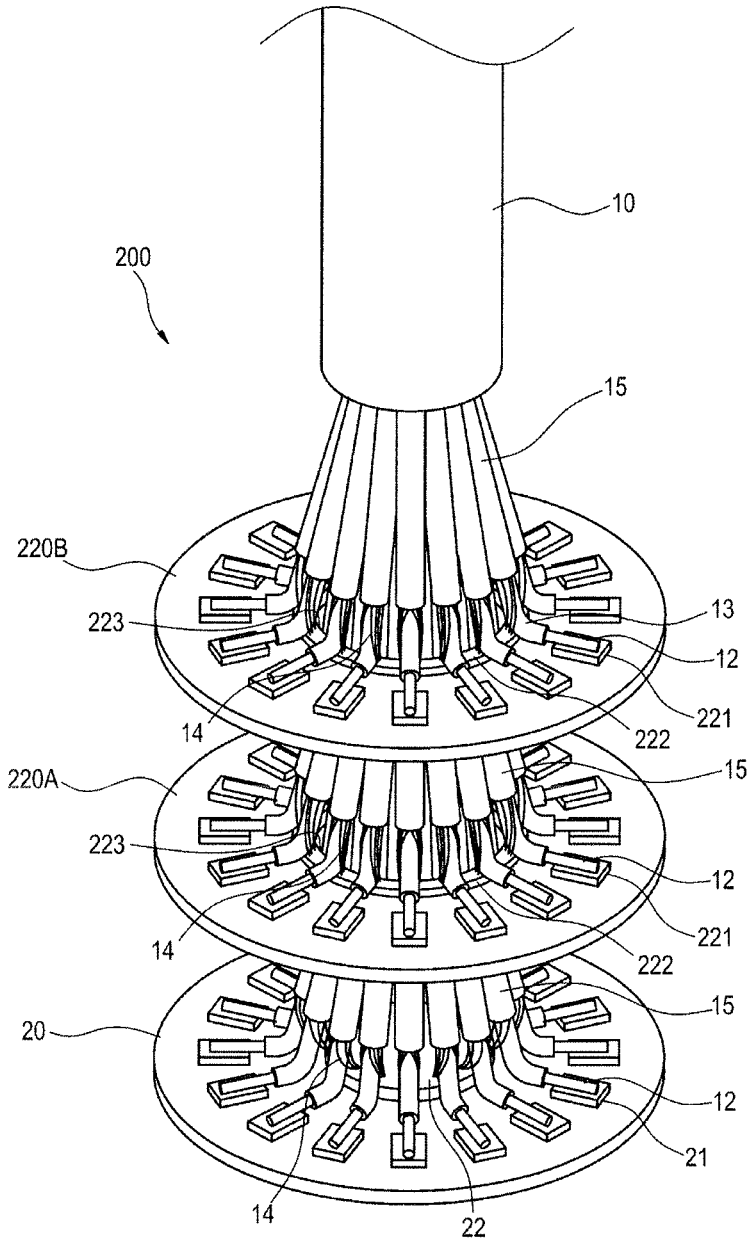
FIG. 5 is a perspective view depicting an example of a coaxial cable having a substrate in accordance with a modified example of the present invention.

Subsequently, a configuration of a modified example of the coaxial cable having a substrate is described with reference to FIG. 5. As shown in FIG. 5, a coaxial cable 200 having a substrate in accordance with the modified example has three printed substrates 20, 220A, 220B, as a printed substrate. The printed substrate 20 (an example of the first substrate) has the similar configuration to the printed substrate 20 of the exemplary embodiment. The printed substrates 220A, 220B (an example of the second substrate) have a plurality of signal pads 221 arranged on the same circumference, a ground pad 222 arranged inside the circumference formed by the plurality of signal pads 221 and an opening 223 formed at a central portion thereof, respectively. The printed substrates 20, 220A, 220B are arranged so that the printed substrates 220A, 220B are stacked between the coaxial cable 10 and the printed substrate 20.

In the coaxial cable 200 having the substrates, the plurality of coaxial wires 11 exposed from the coaxial cable 10 is arranged to form a cylinder shape having a plurality of layers (for example, three layers). The respective center conductors 12 and the respective outer conductors 14 exposed from the plurality of coaxial wires 11, which are arranged at the outermost layer, of the plurality of coaxial wires 11 forming a cylinder shape having the plurality of layers are soldered to the respective signal pads 221 and the ground pad 222 on the printed substrate 220B arranged nearest to the coaxial cable 10. The coaxial wires 11 except for the coaxial wires 11 soldered to the respective signal pads 221 and the ground pad 222 on the printed substrate 220B pass through the opening 223 of the printed substrate 220B. The respective center conductors 12 and the respective outer conductors 14 exposed from the plurality of coaxial wires 11, which are arranged at an outer layer, of the plurality of coaxial wires 11 having passed through the opening 223 of the printed substrate 220B are soldered to the respective signal pads 221 and the ground pad 222 on the printed substrate 220A arranged between the printed substrate 220B and the printed substrate 20. The coaxial wires 11 except for the coaxial wires 11 soldered to the respective signal pads 221 and the ground pad 222 on the printed substrate 220A or the printed substrate 220B pass through the opening 223 of the printed substrate 220A. The respective center conductors 12 and the respective outer conductors 14 exposed from the plurality of coaxial wires 11 having passed through the opening 223 of the printed substrate 220A are soldered to the respective signal pads 221 and the ground pad 222 on the printed substrate 20 arranged farthest from the coaxial cable 10.

In the below, a method of manufacturing the coaxial cable 200 having the substrates is described. First, the lengths of the coaxial wires 11 are cut into three stages. Specifically, the lengths of the respective coaxial wires 11 are cut so that the coaxial wires 11 to be connected to the printed substrate 220B are shortest, the coaxial wires 11 to be connected to the printed substrate 220A are second longest and the coaxial wires 11 to be connected to the printed substrate 20 are longest. In each group (stage) in which the lengths are equal, the center conductors 12, the inner insulators 13, the outer conductors 14 are exposed by predetermined lengths. The outer conductors 14 are collected with being bent in an opposite direction to the bending direction of the inner insulators 13 (i.e., the outer conductors 14 of parts at which the inner insulators 13 are bent are turned around in the opposite side).

Then, the coaxial wires 11 to be connected to the printed substrate 20 and the coaxial wires 11 to be connected to the printed substrate 220A are enabled to pass through the opening 223 of the printed substrate 220B. Then, the center conductor 12 and the outer conductor 14 of each the coaxial wire 11 in the group consisting of the shortest coaxial wires 11 are respectively connected (soldered) to the signal pad 221 and the ground pad 222 of the printed substrate 220B. Thereafter, the coaxial wires 11 to be connected to the printed substrate 20 are enabled to pass through the opening 223 of the printed substrate 220A. Then, the center conductor 12 and the outer conductor 14 of each the coaxial wire 11 in the group consisting of the second longest coaxial wires 11 of the coaxial wires 11 having passed through the opening 223 of the printed substrate 220B are respectively connected (soldered) to the signal pad 221 and the ground pad 222 of the printed substrate 220A. Finally, the center conductor 12 and the outer conductor 14 of each coaxial wire 11 having passed through the opening 223 of the printed substrate 220A are respectively connected (soldered) to the signal pad 21 and the ground pad 22 of the printed substrate 20. In the meantime, after the coaxial wires 11 are enabled to pass through the respective openings 223 and the relative positions of the printed substrates 20, 220A, 220B are determined, the center conductors 12 and the outer conductors 14 may be connected to the respective printed substrates (i.e., the connection may be started from any printed substrate).

As described above, according to the configuration of the modified example shown in FIG. 5, the printed substrate is divided into a plurality of printed substrates, so that it is possible to make each substrate smaller and to attach the more coaxial wires 11 to the printed substrates.

Although the present invention has been described in detail with reference to the specific exemplary embodiments, a variety of changes and modifications can be made without departing from the spirit and scope of the present invention.

What is claimed is:

1. A coaxial cable comprising:

a coaxial wire in which an inner insulator, an outer conductor and a sheath are sequentially and coaxially provided around a center conductor; and a substrate having a surface on which a first contact pad and a second contact pad are arranged, wherein the sheath is removed at one end portion of the coaxial wire by a predetermined length, so that the inner insulator and the outer conductor are exposed, and a tip end of the inner insulator is removed by a predetermined length, so that the center conductor is exposed, wherein the exposed portion of the center conductor is soldered to the first contact pad with the exposed portion of the inner insulator being bent relative to the sheath, and the exposed portion of the outer conductor is soldered to the second contact pad with being bent in a direction different from the bending direction of the inner insulator, and wherein a part of the coaxial wire covered by the sheath is standing at an angle of 30° or greater relative to the surface of the substrate, wherein the first contact pad comprises a plurality of contact pads arranged on the same circumference on the substrate, wherein the second contact pad is arranged inside the same circumference on the substrate, and wherein each of the center conductors exposed from a plurality of the coaxial wires is fixed to each of the plurality of first contact pads and the respective outer conductors exposed from the plurality of coaxial wires are fixed to the second contact pad, so that the plurality of coaxial wires is arranged in a cylinder shape.

2. The coaxial cable according to claim 1, wherein the substrate comprises a first substrate and a second substrate arranged above the first substrate and having an opening formed at a central portion thereof, wherein the plurality of coaxial wires is arranged in a cylinder shape having a plurality of layers, and wherein the coaxial wires to be connected to the first substrate pass through the opening of the second substrate.

3. A method of manufacturing a coaxial cable, comprising:

(a) at a terminal portion of a coaxial wire in which an inner insulator, an outer conductor and a sheath are sequentially and coaxially provided around a center conductor, removing the sheath by a predetermined length to expose the inner insulator and the outer conductor and removing a tip end of the inner insulator by a predetermined length to expose the center conductor;

(b) soldering the exposed portion of the center conductor to a first contact pad of a substrate with the inner insulator or the center conductor exposed from the sheath being bent relative to the sheath; and (c) bending the exposed portion of the outer conductor in a direction different from the bending direction of the inner insulator or the center conductor and soldering the same to a second contact pad of the substrate, and standing a part of the coaxial wire covered by the sheath so as to form an angle of 30° or greater relative to the substrate, wherein in the process (b) of soldering the exposed portion of the center conductor, each of the center conductors exposed from a plurality of the coaxial wires is fixed to each of a plurality of the first contact pads arranged on the same circumference on the substrate, and wherein in the process (c) of soldering the exposed portion of the outer conductor, the respective outer conductors exposed from the plurality of coaxial wires are fixed to the second contact pad arranged inside the same circumference on the substrate.

4. The method according to claim 3, wherein the substrate comprises a first substrate and a second substrate having an opening formed at a central portion thereof, and the method further comprises:

(d) letting some coaxial wires of the plurality of coaxial wires pass through the opening of the second substrate;

(e) executing the process (b) of soldering the exposed portion of the center conductor and the process (c) of soldering the exposed portion of the outer conductor for the coaxial wires having not passed through the opening of the second substrate, on the second substrate; and (f) executing the process (b) of soldering the exposed portion of the center conductor and the process (c) of soldering the exposed portion of the outer conductor for the coaxial wires having passed through the opening of the second substrate, on the first substrate.

* * * * *